US011882914B2

(12) United States Patent
Miranda de Faria et al.

(10) Patent No.: US 11,882,914 B2
(45) Date of Patent: Jan. 30, 2024

(54) REFILLING METHOD AND REFILLABLE BOTTLE

(71) Applicant: Natura Cosméticos S.A., São Paulo (BR)

(72) Inventors: Márcio Miranda de Faria, Cajamar (BR); Thiago Milano de Oliveira, Cajamar (BR); Gideon Moreira Ferreira, Cajamar (BR); Josué Ferreira, São Paulo (BR)

(73) Assignee: NATURA COSMÉTICOS S.A., São Paulo (BR)

( * ) Notice: Subject to any disclaimer, the term of this patent is extended or adjusted under 35 U.S.C. 154(b) by 0 days.

(21) Appl. No.: 17/760,188

(22) PCT Filed: Feb. 5, 2021

(86) PCT No.: PCT/BR2021/050056
§ 371 (c)(1),
(2) Date: Aug. 5, 2022

(87) PCT Pub. No.: WO2021/155454
PCT Pub. Date: Aug. 12, 2021

(65) Prior Publication Data

US 2023/0081620 A1 Mar. 16, 2023

(30) Foreign Application Priority Data

Feb. 6, 2020 (BR) ..... 102020002566-0

(51) Int. Cl.
*A45D 34/04* (2006.01)
*A45D 40/26* (2006.01)
(Continued)

(52) U.S. Cl.
CPC ..... *A45D 34/041* (2013.01); *A45D 34/043* (2013.01); *A45D 34/045* (2013.01);
(Continued)

(58) Field of Classification Search
CPC ..... B65D 25/38; B65D 41/04; B65D 47/04; B65D 83/00; B65D 41/00; A45D 34/041;
(Continued)

(56) References Cited

U.S. PATENT DOCUMENTS 6,511,243 B2 1/2003 Miranda
2006/0165475 A1 7/2006 Kervoalen
2008/0107474 A1* 5/2008 Hsieh ..... A61H 15/0092 401/209

FOREIGN PATENT DOCUMENTS

BR MU8700104 U 8/2008
EP 0046038 A2 2/1982
(Continued)

OTHER PUBLICATIONS

International Search Report and Written Opinion for International Application No. PCT/BR2021/050056, dated Mar. 25, 2021 (15 pages), Instituto Nacional da Propriedade Industrial, Rio de Janeiro/RJ, Brazil.

(Continued)

*Primary Examiner* — David J Walczak
(74) *Attorney, Agent, or Firm* — Alston & Bird LLP

(57) ABSTRACT

A refillable bottle (10) is provided, comprising a lid (1) that can be connected to an applicator (2) and a storage portion (3) that can be connected to the applicator (2), in which the lid (1), the applicator (2) and the storage portion (3) are connected together using screw threads in the lid (1), the applicator (2) and the storage portion (3). An accompanying method for refilling a bottle (10) is also provided, comprising the following steps: disconnecting the storage portion (3) from the applicator (2) by means of a first unscrewing action, and connecting a refill (20) to the applicator (2), in which the force required to perform the first unscrewing action is greater than the force required to perform a second (Continued)

unscrewing action, the second unscrewing action being understood to be the action performed to disconnect the lid (1) from the applicator (2).

11 Claims, 13 Drawing Sheets

(51) Int. Cl.
*B65D 25/38* (2006.01)
*B65D 41/04* (2006.01)
*B65D 47/04* (2006.01)
*B65D 83/00* (2006.01)

(52) U.S. Cl.
CPC ..... *B65D 25/38* (2013.01); *B65D 41/04* (2013.01); *B65D 47/04* (2013.01); *B65D 83/00* (2013.01); *A45D 40/261* (2013.01)

(58) Field of Classification Search
CPC .. A45D 34/043; A45D 34/045; A45D 40/261; B43M 11/02
USPC ..... 401/202, 213, 262, 269, 216
See application file for complete search history.

(56) References Cited

FOREIGN PATENT DOCUMENTS

| | | |
|---|---|---|
| EP | 0712592 A1 | 5/1996 |
| EP | 1673998 A1 | 6/2006 |
| GB | 2195296 A | 4/1988 |

OTHER PUBLICATIONS

International Preliminary Report On Patentability for International Application No. PCT/BR2021/050056, dated Mar. 7, 2022, (53 pages), Instituto Nacional da Propriedade Industrial, Rio de Janeiro/RJ, Brazil.

Response to Written Opinion for International Application No. PCT/BR2021/050056, dated Dec. 2, 2021, (62 pages), as filed before the Brazilian Patent and Trademark Office, Rio de Janeiro/RJ, Brazil.

* cited by examiner

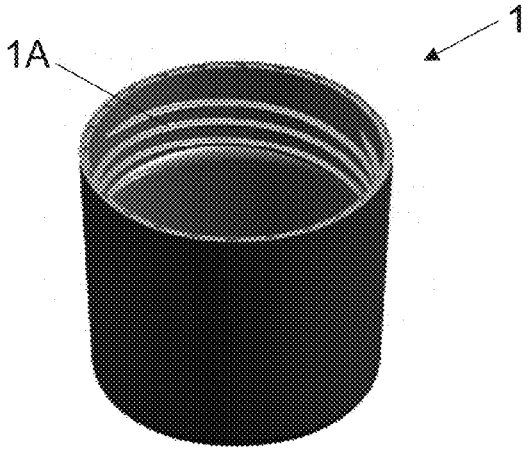
FIG. 4 (a)
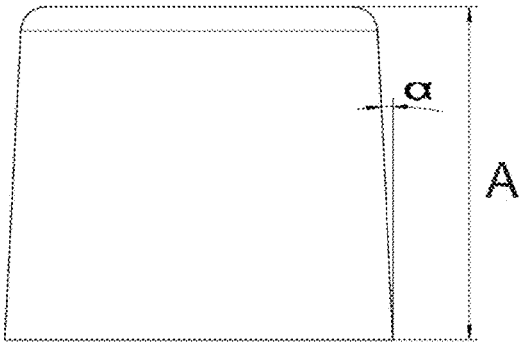
FIG. 4 (b)
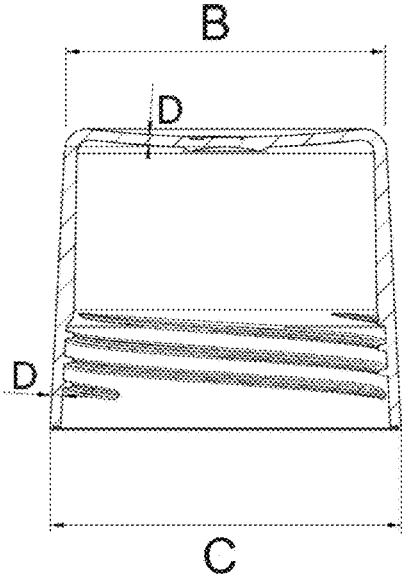
FIG. 4 (c)
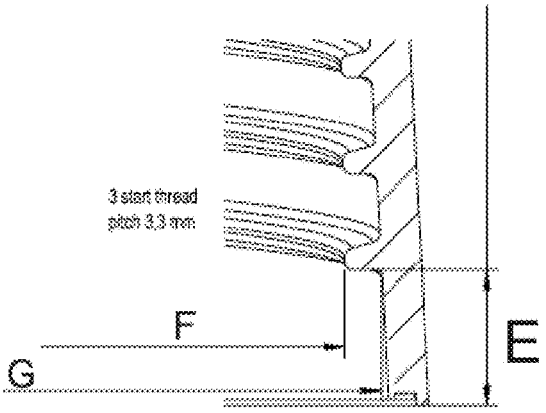
FIG. 4 (d)
FIG. 4

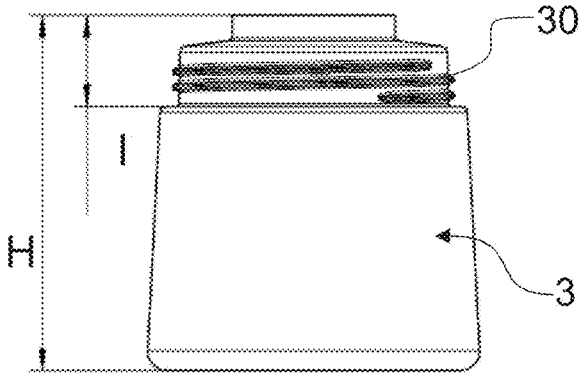
FIG. 5 (a)
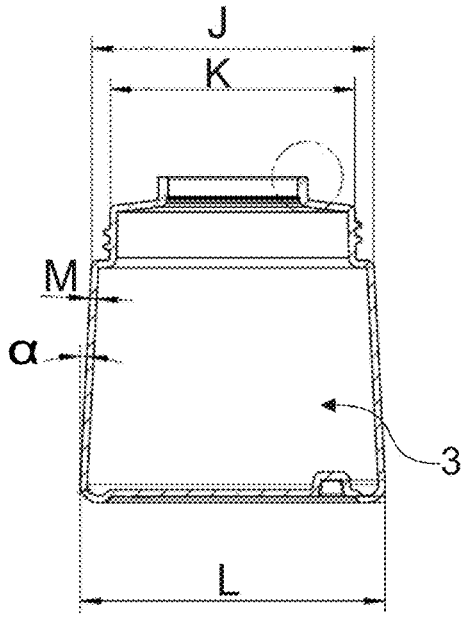
FIG. 5 (b)
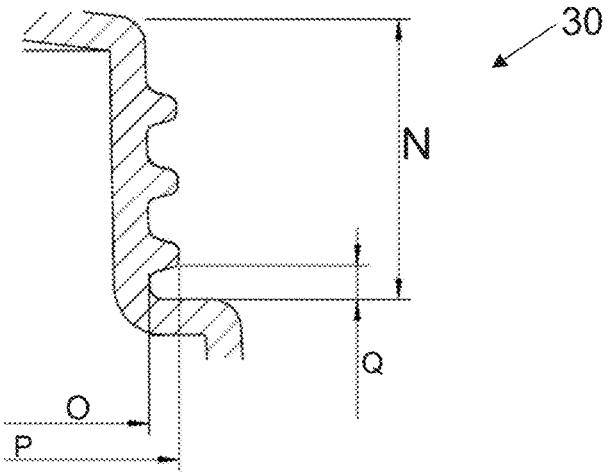
FIG. 5 (c)
FIG. 5

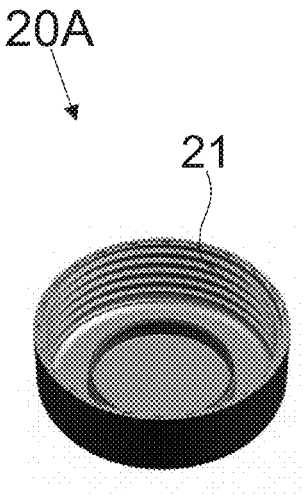
FIG. 6 (a)
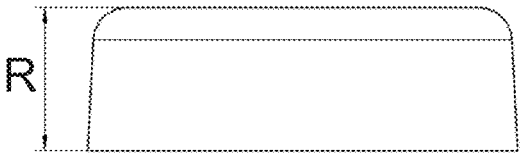
FIG. 6 (b)
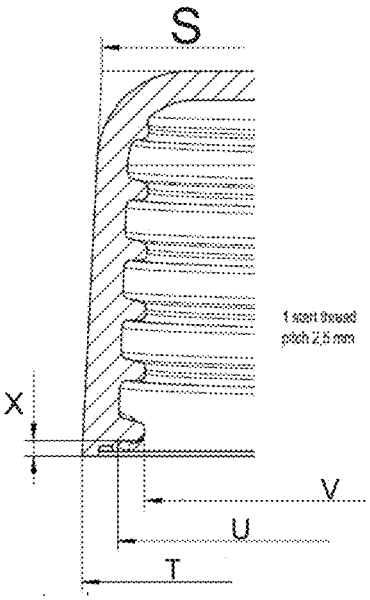
FIG. 6 (c)
FIG. 6

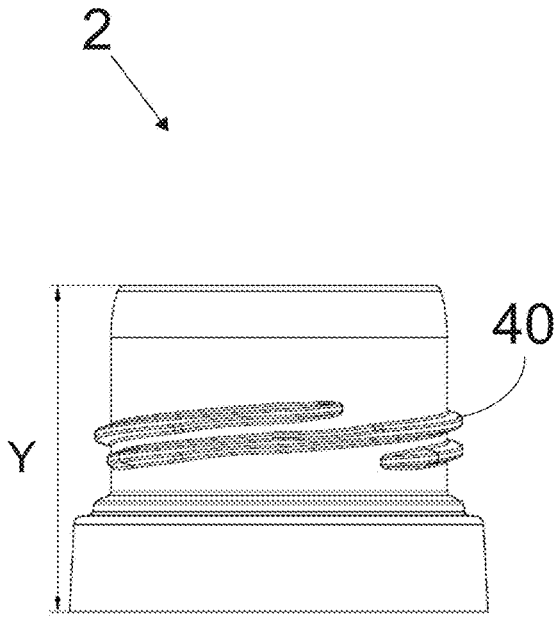
FIG. 7 (a)
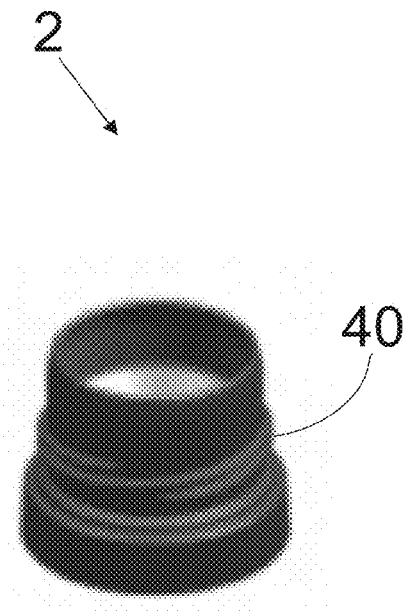
FIG. 7 (b)
FIG. 7

REFILLING METHOD AND REFILLABLE BOTTLE

CROSS REFERENCE TO RELATED APPLICATIONS

This application is a national stage application, filed under 35 U.S.C. § 371, of International Application No. PCT/BR2021/050056, filed Feb. 5, 2021, which claims priority to Brazilian Application No. BR102020002566-0, filed Feb. 6, 2020, the contents of both of which as are hereby incorporated by reference in their entirety.

BACKGROUND

Technical Field

The present invention refers to a refilling method and a refillable bottle. More specifically, the teachings of the present invention address a refilling method for a bottle popularly known as roll-on as well as a refillable bottle, such as a roll-on bottle. The present invention also covers a usable refill.

Description of Related Art

Packages and bottles are commonly used for storing cosmetic products and products of daily use, such as shampoos, creams, deodorants, among others.

Among the several types of existing bottles, it is noted the bottle popularly known as roll-on, which bottle comprises an applicator ball and which has the purpose of applying a certain product to the user's skin. Usually, the application of the product occurs by means of the occurrence of contact between the applicator ball itself and the user's skin.

It occurs that the roll-on bottles known to the state of the art present certain disadvantages.

One initial disadvantage resides in the fact that, when the product finishes the entire bottle must be discarded (not only the portion which comprises the product), whereby the user must acquire a completely new bottle. In this way, when discarding the entire bottle, the user is also discarding, for example, the applicator ball and the lid of the bottle, which elements, despite being discarded, are in perfect state to the used again.

Thus, discarding the roll-on bottle is harmful both to the environment, since it cannot be ensured that all the components will be destined to recycling, as to the user, who must acquire a complete new product.

Thus, an initial problem in connection with roll-on bottles resides in the discarding of components that would be fully in conditions to be used again.

Even if the state of the art can disclose refillable roll-on bottles, it is found that said bottles are difficult for the user to use or are of poor assembly, causing disconnection of components which should remain fixed during the application of the product.

In some cases, there are bottles which, when receiving a determined force by the user for removal of the lid of the bottle, end by also causing the disconnection of the element which stores the product to be applied. That is, the user, when performing an action to remove the lid and consequently use the product, ends by disconnecting the refill from the bottle, thus causing discomfort in the use of the product.

Thus, the present invention aims at overcoming the problems of the state of the art and relative to roll-on bottles, and more specifically, connected to the refilling of roll-on bottles.

BRIEF SUMMARY

The present invention has as objective providing a method for refilling and a refillable bottle.

It is an additional objective of the present invention to propose a refillable bottle which uses the concepts known as conemorse.

A further objective of the present invention consists in a refillable bottle wherein the force required to unscrew the first portion of the bottle is greater than the force required to unscrew a second portion of the bottle.

An additional objective of the present invention consists in providing a refillable bottle, wherein the refillable bottle is a roll-on bottle.

An additional objective of the present invention consists in providing a refillable bottle, wherein the refillable bottle is a deodorant bottle.

A usable refill in a refillable bottle is further proposed.

A refillable bottle is described comprising a lid connected to an applicator, and a storage portion connected to the applicator, wherein the connection between the lid, applicator and storage portion occurs through threads on the lid, in the applicator, and in the storage portion. There is further described a method for refilling a bottle, said bottle comprising a lid connected to an applicator and a storage portion connected to the applicator, wherein the method comprises the steps of: disconnecting the storage portion from the applicator and by means of a first unscrewing action, and connect the refill to the applicator, wherein the force required to perform a first unscrewing action is greater than the force required to perform a second unscrewing action, the second unscrewing action being understood as being the action performed to disconnect the lid from the applicator.

BRIEF DESCRIPTION OF THE FIGURES

The present invention shall be described as follows, in more detail based on an execution example represented in the drawings. The figures show:

FIG. 4—is an internal representation of an embodiment of the lid which integrates the refillable bottle proposed in the present invention, wherein FIG. 4(*a*) illustrates the internal thread of the lid and FIGS. 4(*b*), 4(*c*) and 4(*d*) illustrate dimensions of said lid.

FIG. 5—is a representation of the storage portion which integrates the refillable bottle proposed in the present invention, wherein FIG. 5(*a*) is a frontal representation, FIG. 5(*b*) is a sectional representation and FIG. 5(*c*) is a featured representation of the thread element of the storage portion;

FIG. 6—is a featured representation of the refill lid, wherein FIG. 6(*a*) illustrates the internal thread thereof, while FIG. 6(*b*) illustrates the frontal view and FIG. 6(*c*) is a featured representation of the internal thread;

FIG. 7—illustrates the applicator which is used in the bottle proposed in the present invention, wherein FIGS. 7(*a*) and 7(*b*) illustrate the external thread of the applicator;

DETAILED DESCRIPTION OF VARIOUS EMBODIMENTS

Figure 1:
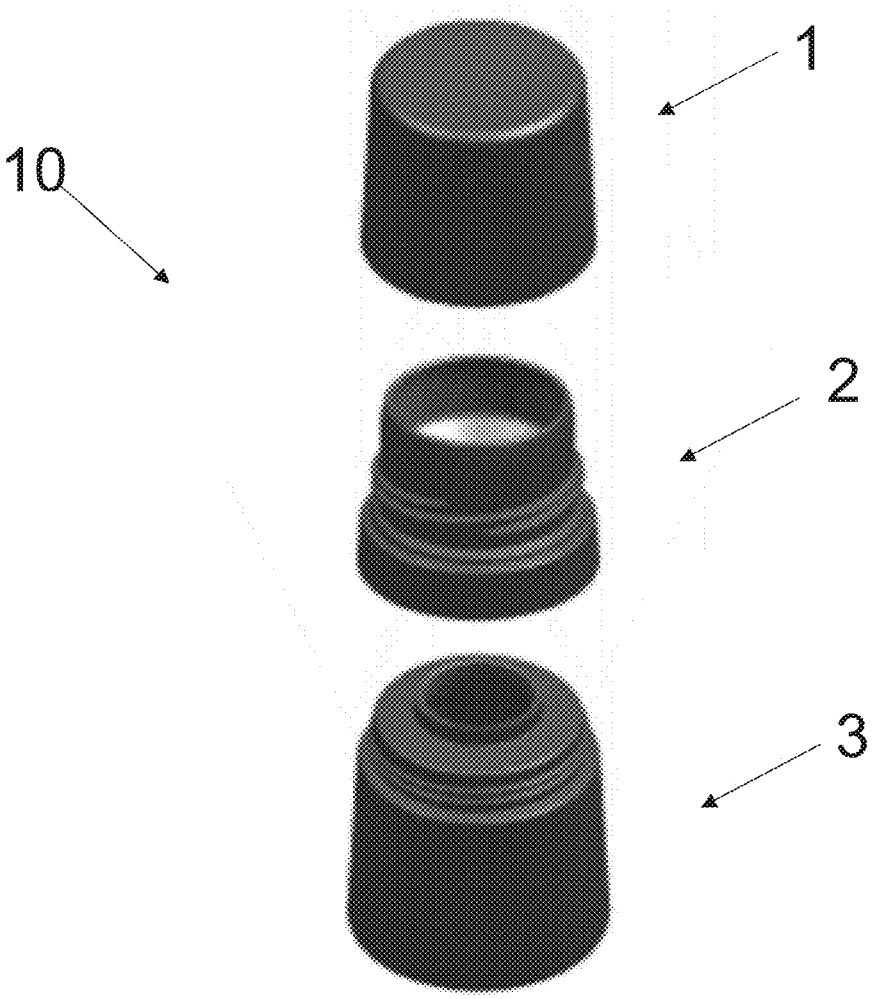
FIG. 1—is a perspective representation of an embodiment of the refillable bottle proposed in the present invention.

As observed in FIGS. 1 to 13, the present invention describes a refilling method as well as a refillable bottle 10 (also referenced just as bottle 10). In an exemplary way only, the teachings of the present invention are applied to bottles 10 popularly known as roll-on, such as deodorant bottles, anyway, it must be emphasized that said fact must not be considered as being a limiting characteristic. It is thus understood that the teachings of the present invention can be applied to any type of bottles and packages.

Referring to FIGS. 1 to 13, the bottle 10 comprises a lid 1, an applicator 2 and a storage portion 3. The storage portion 3 can be understood as being the portion which stores the product to be applied by the user. Applicator 2 can, for example, contain an applicator ball 2A, thus configuring a roll-on bottle.

In summary, the teachings of the present invention enable the refilling of the bottle 10 (such as, for example, a bottle 10 of roll-on deodorant).

More specifically, the teachings of the present invention approach the concept of conemorse in bottle 10 proposed in the present invention. Thus, bottle 10 can be used simply unscrewing the lid 1, without unscrewing the portion which holds the product, that is, the storage portion 3.

Thus, the conemorse concept refers to the fitting of threads with specific profile and angulation which, when fitted—female part and male part—the force required to unscrew (unscrewing action) is much greater in storage portion 3 than in the lid 1.

The proposed bottle 10 basically comprises a lid 1, an applicator 2 and a storage portion 3. Said elements can, exemplarily, be made from polypropylene and polyethylene resins.

Bottle 10 proposed in the present invention is configured as being a refillable bottle, in this sense, it is proposed that the storage portion 3 is replaceable by a refill 20.

In this manner, the refilling of bottle 10 is performed through replacing the storage portion 3 and reusing the applicator set (lid 1 with applicator 2). This refilling concept has as main purpose reducing residues, since, with the use of the refill 20 the discard of the applicator set is avoided (regular lid 1 and applicator 2), so that the only part destined to recycling will be the storage portion 3, already used.

In this embodiment proposed for the refillable bottle 10, the configuration of the threads which couple the portion 3 to the applicator 2, provides a greater unscrewing force (unscrewing action) to the set of lid thread 1 with the external thread of the applicator bottle 2 around 50% to 80% more, measured in lb/in.

For use of the bottle 10, the lid 1 must be removed unscrewing it (unscrewing action) in the counterclockwise direction, the application/transfer of the product to the skin is made through the turn of the applicator ball 2A in direct contact with the skin, the turn being made through circulatory movements of the applicator ball 2A on the skin.

To carry out the refilling, the applicator 2 must be removed from the portion 3 and, consequently the replacement of the portion 3 with a new bottle with the product (refill 20), screwing it to the applicator 2 in clockwise direction.

The angulation range to provide these differences in forces between these sets was considered around: 0.50 to 1.90 degrees for the internal thread of the applicator 2 with the external thread of the bottle 3, added to the angulation range of the thread of the lid 1 with the external thread of the applicator 2 between 3.50 to 6.0 degrees.

This angulation/degree premise between the threads provides the difference in force in the threading of the sets, that is, it is what prevents that when opening the lid 1 the housing 2 is simultaneously unscrewed from the bottle 3. If this were to occur, it would generate discomfort and difficulty to the user at the moment of use of the product, that is, without these angulations, the set (bottle 10) would not function perfectly.

Figure 2:
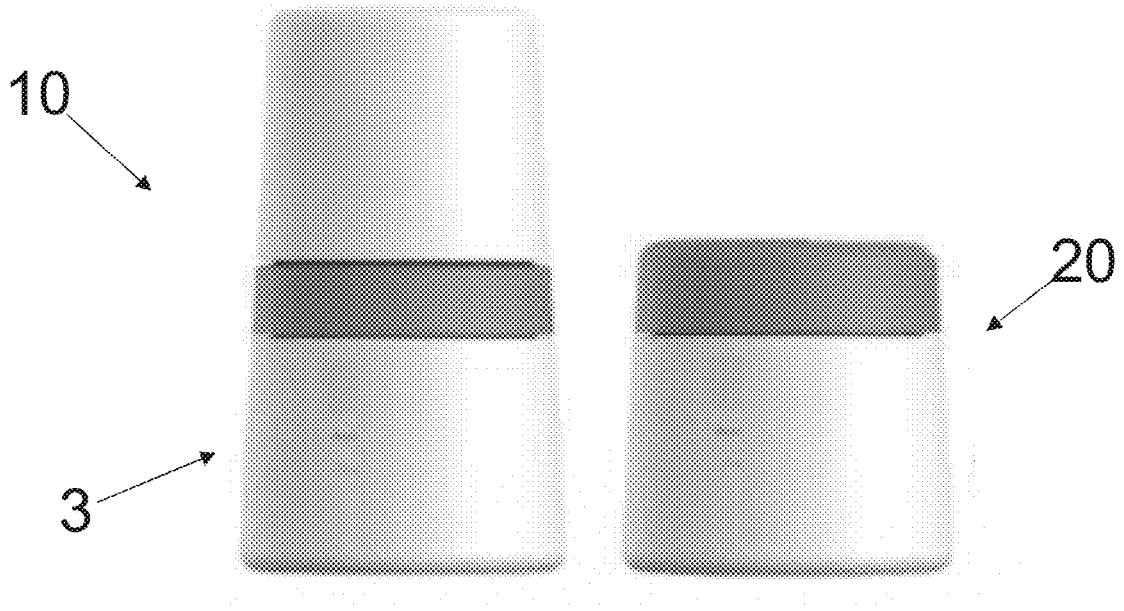
FIG. 2—is a representation of the refillable bottle proposed in the present invention, wherein FIG. 2(*a*) is a representation of the bottle and FIG. 2(*b*) is a representation of the refill able to be used in the refillable bottle.
Figure 3:
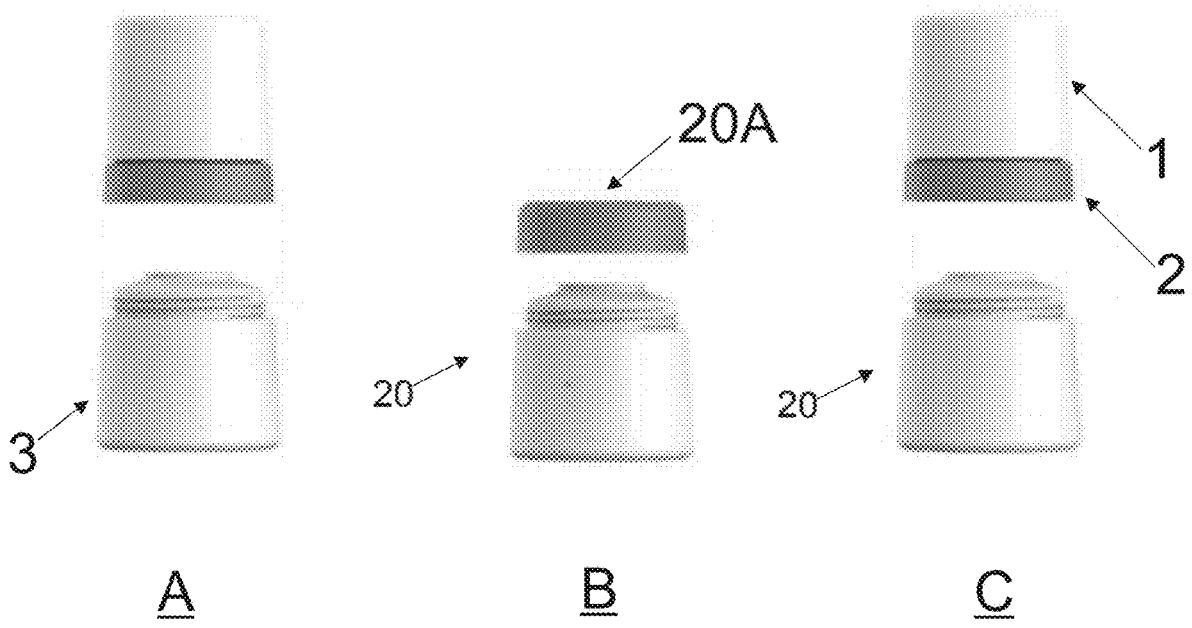
FIG. 3—is a representation of an embodiment of the refillable bottle proposed in the present invention, indicating the steps to be carried out for the refilling of the bottle to occur.

The FIG. 2(*a*) of the present application is a representation of the bottle 10, while the FIG. 2(*b*) illustrates the refill 20 to be used in place of the storage portion 3. FIG. 3 is a representation of the necessary steps for replacing the storage portion 3, thus performing the refilling of the bottle 10 proposed in the present invention.

Thus, in a step A the storage portion 3 must be unscrewed (unscrewing action), subsequently, in a step B the lid 20A of the refill 20 must be removed, and subsequently (step C) the refill 20 must be threaded on the lid 1 and applicator 2 set.

FIG. 4 illustrates a representation of an embodiment of the lid 1 which integrates the refillable bottle 10 proposed in the present invention, wherein FIG. 4(*a*) is an internal representation of the referred lid 1, indicating the internal thread thereof 1A. FIG. 4(*b*) illustrates the lid 1 and some of its dimensions, so it is proposed that this comprises a height A in the range of 40.0 millimeters as well as a start angle $\alpha$ relative to a vertical plan in the range between 2° to 5°, so that a value of 3° is considered as preferred.

FIG. 4(*c*) indicates that the lid 1 comprises a diameter B in the upper portion thereof (upper diameter of lid B), around 42 mm and a diameter in its lower portion (lower diameter of the lid C) around 46 mm. A thickness D of the lid is situated in the range from 1 mm to 1.6 mm, wherein a value of 1.4 mm is considered preferred.

FIG. 4(*d*) illustrates in greater details the arrangement proposed for the internal thread 1A of the lid, thus, a starting height of the thread E is proposed in the range between 4.0 mm to 5 mm, wherein a value of 4.7 mm can be considered as preferred. A first start diameter of the thread F is situated at approximately 41.0 mm, and a second start diameter of the thread G is situated at 43.0 mm. Finally, the thread pitch of internal thread 1A is situated in the range between 3.0 mm and 3.5 mm, so a value of 3.3 mm is considered preferred. Moreover, it is proposed that the internal thread 1A be a three-entry thread.

FIG. 5 illustrates in greater details the configuration proposed for the storage portion 3 and refill 20. Referring to FIG. 5(*a*) it is proposed that the storage portion 3 comprises a height H in the range from 50 mm to 60 mm, so a value of 55 mm is considered preferred. The height of the nozzle and thread 1 is situated in the range between 10 and 16 mm, so a value of 14.5 mm is considered preferred.

Referring to FIG. 5(*b*) it is proposed that the storage portion 3 comprises a greater external diameter J in the range of 45 mm to 50 mm (preferably 48.5 mm) and a nozzle diameter K between 39 mm to 44 mm (preferably 42 mm). A lower diameter L in the storage portion 3 is situated in the range from 50 mm to 55 mm, wherein a value of 52.5 is considered preferred. The storage portion 3 further defines a start angle α relative to the vertical plane in the range from 2° to 5°, wherein the value of 3° is considered preferred. A thickness M of the storage portion 3 is situated in the range between 1.0 mm to 1.5 mm, wherein the value of 1.2 mm is considered preferred.

FIG. 5(*c*) is a featured representation of the thread element of the storage portion 30 (external thread of the storage portion 30). Referring to said figure, it is proposed that the nozzle comprises a height N between 8 mm to 11 mm (a value of 9 mm is considered preferred), while a third thread start diameter O assumes a preferred value of 42 mm, and a fourth thread start diameter P assumes a preferred value of 44 mm.

Still referring to FIG. 5(*c*), a thread start height Q assumes a preferred value of 1.15 mm and the pitch of the thread element of the storage portion 30 is between 2.0 mm and 3.0 mm, for example 2.5 mm. Additionally, it is proposed that the thread of the storage portion 30 have an inlet and length of 720°.

FIG. 6 is a featured representation of the lid 20A of the refill 20, lid 20A which comprises an internal thread 21, and is endowed with a height R preferably of 16 mm, such as illustrated in FIGS. 6(*a*) and 6(*b*). The lid 20A further comprises an upper diameter S being preferably 46 mm and a lower diameter T being preferably 48 mm.

A fifth thread start diameter V assumes a preferred value of 43 mm and a sixth thread start diameter U assumes a preferred value of 45 mm. A thread start height X has a preferred vale of 0.65 mm, such as illustrated in FIG. 6(*c*). Further, it is proposed that the pitch of the thread element 21 be 2.5 mm and that the thread 21 is an entry thread.

Figure 8:
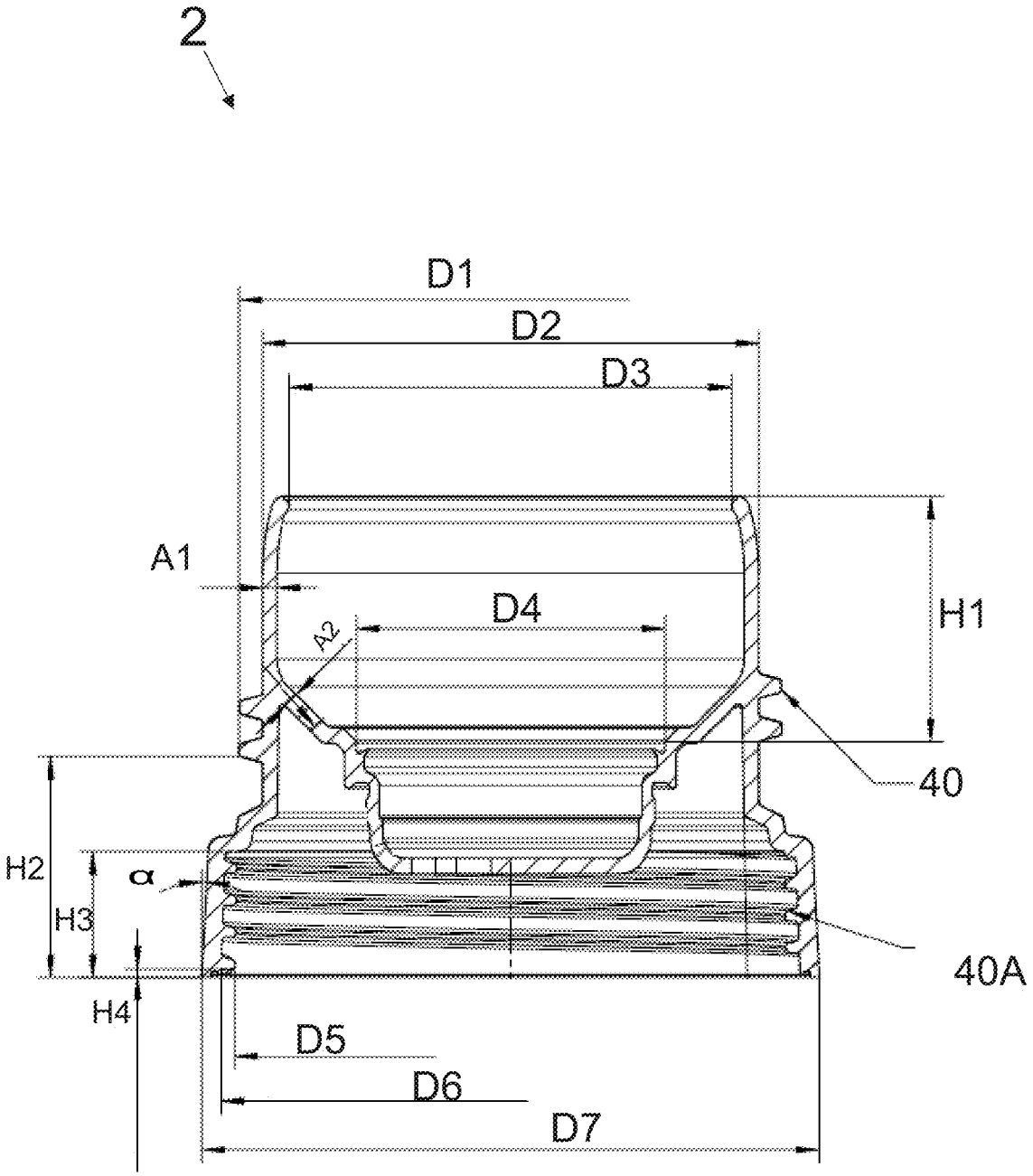
FIG. 8—illustrates a sectional view of the applicator used in the refillable bottle proposed in the present invention, further illustrating the structural arrangement of the applicator.

FIGS. 7 and 8 illustrate the applicator 2 which integrates the bottle 10 proposed in the present invention. It is observed from FIGS. 7(*a*) and 7(*b*) the external thread of the applicator 40 and, referring to FIG. 7(*a*) it is proposed that the height of the applicator Y is preferably 37.5 mm.

FIG. 8 illustrates a sectional view of the applicator 2, further illustrating the internal thread of the applicator 40A. Furthermore, FIG. 8 allows a clear visualization of the structural arrangement of the applicator 2, further indicating the main dimensions thereof. The preferred values for the dimensions shown in FIG. 8 are shown in the following table:

| | |
|---|---|
| D1 | 42 mm |
| D2 | 38 mm |
| D3 | 34.5 mm |
| D4 | 24.0 mm |
| D5 | 43.0 mm |
| D6 | 45.0 mm |
| D7 | 48.0 mm |
| H1 | 19.0 mm |

-continued

| | |
|---|---|
| H2 | 17.0 mm |
| H3 | 9.8 mm |
| H4 | 0.65 mm |
| A1 | 1.1 mm |
| A2 | 1.2 mm |
| α | 3° |

Additionally, it is proposed that the pitch of the external thread 40 is between 8 mm and 11 mm, for example, 10 mm and its length 180°, in which the external thread 40 is a 3-inlet thread. The pitch of the 40A internal thread is between 2.0 mm and 3.0 mm, for example, 2.5 mm, whereas the 40A internal thread is a single entry thread.

Figure 9:
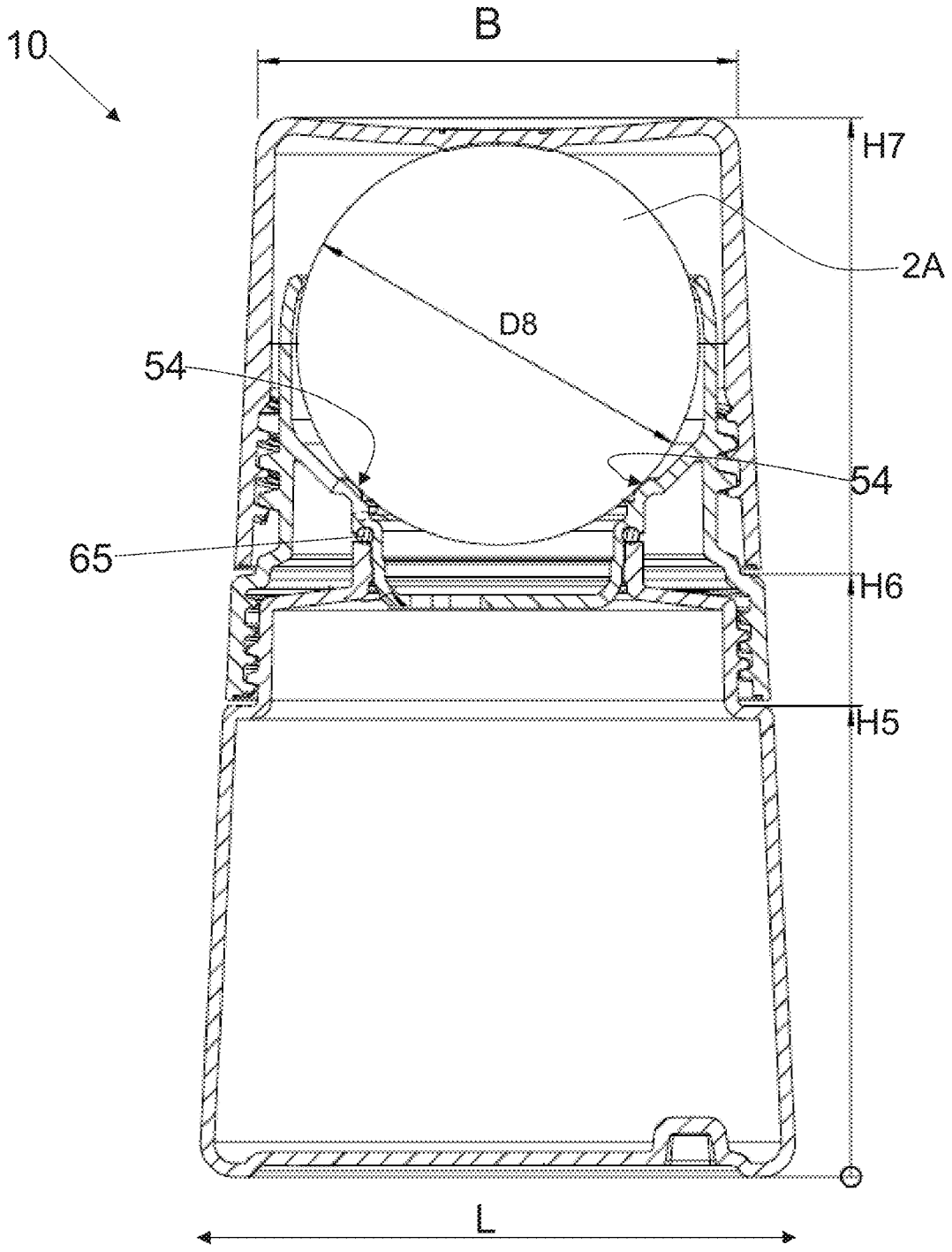
FIG. 9—is a sectional view of the refillable bottle proposed in the present invention.

FIG. 9 is a sectional view of the bottle 10 proposed in the present invention, wherein from said figure the arrangement proposed for the applicator ball 2A is observed, this having a diameter D8 of 1.4 inches (35.56 mm).

Further, from FIG. 9, the representation of the heights H5, H6 and H7 is observed, whereby these assume preferred values of 41 mm, 53 mm and 93 mm, respectively. It is understood from FIG. 9 that the height H7 represents the height of the refillable bottle 10, whereby this is preferably lower than 100 mm.

Referring to FIGS. 8, 9, 10 and 11 it is observed that the arrangement of the applicator ball 2A in the applicator 2 occurs such that the applicator 2 defines a substantially vertical portion 50 (a tilt of up to approximately 3° would be acceptable) which defines in its external surface the external thread 40 of the applicator 2, so that the vertical portion 50 has a first end 51 (upper end) slightly inclined in the direction of the applicator ball 2A (that is, "into" the bottle), wherein said tilt defines the diameter D3 (third diameter of the applicator D3).

The second end 51A of vertical portion 50 is connected to a step projection 52 which increases the diameter of the applicator 2, thus defining the diameter D7 and the internal thread 40A of the applicator, such as illustrated in FIG. 8.

Referring to FIGS. 8, 9, 10 and 11, it is observed that from the vertical portion 50, at a point of its height coincident with the external thread start 40, there is the start of a third projection 53 which projects into the applicator 2 and which defines touch points 54 between the applicator ball 2A and the third projection 53. The referred touch points 54, which are configured as a projection from the third projection 53, can be better observed from pictures 9, 10 and 11.

From the referred touch point 54, there is defined a concave portion 55 limited by a tooth 56, wherein from the referred tooth 56, there begins a corrugated stretch (reference 57) which reduces the diameter of the applicator 2, so that, at the end of the corrugated stretch there are substantially vertical portions 58 and 59 connected by a step 60. Still from FIGS. 8, 9, 10 and 11, it is observed that from vertical portion 59 there begins a crib equipped with a horizontal segment 61 connected to the vertical portion 59 through a curved segment 62.

Figure 10:
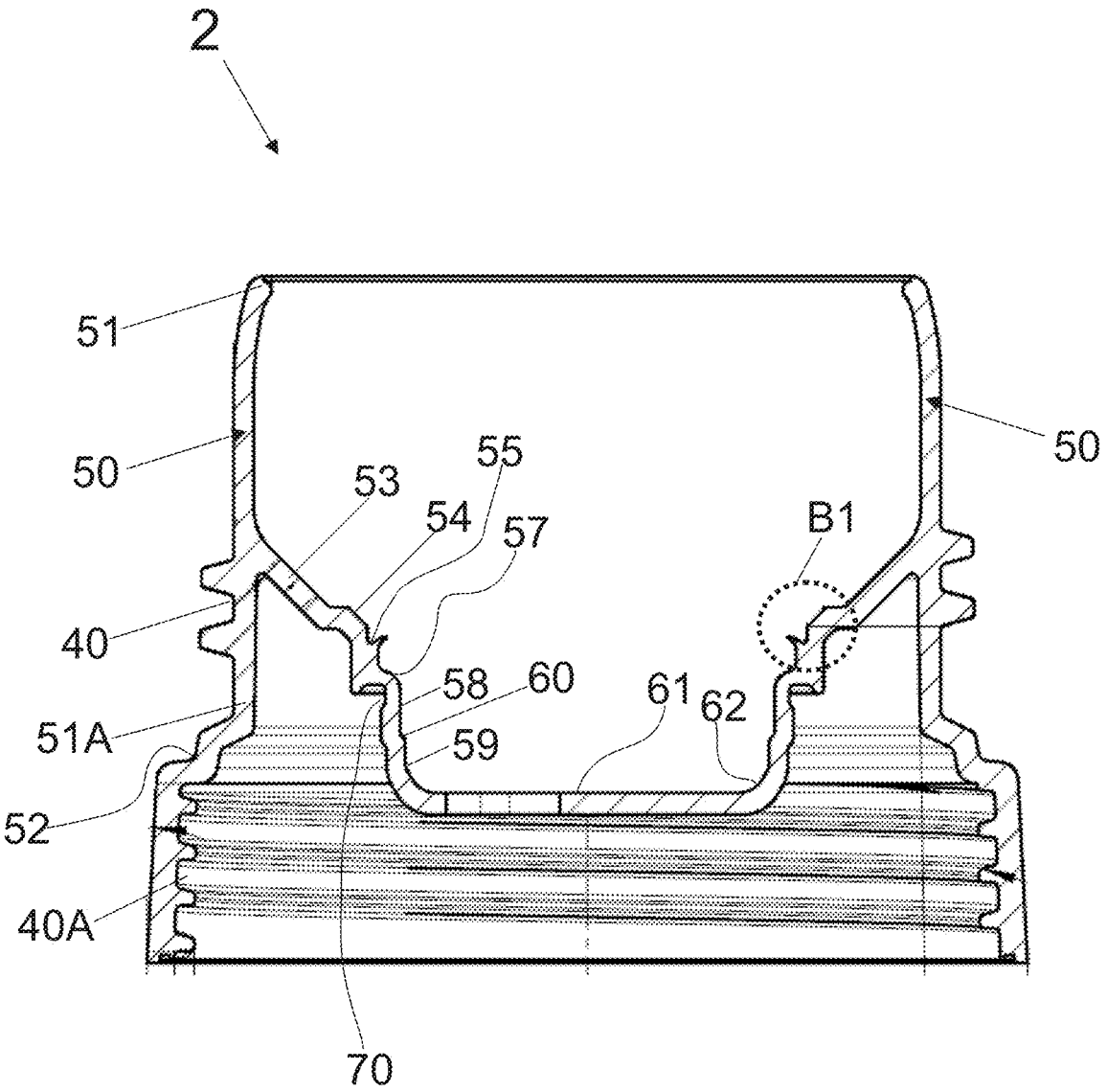
FIG. 10—is an additional representation of the applicator, illustrating the structural arrangement thereof.
Figure 11:
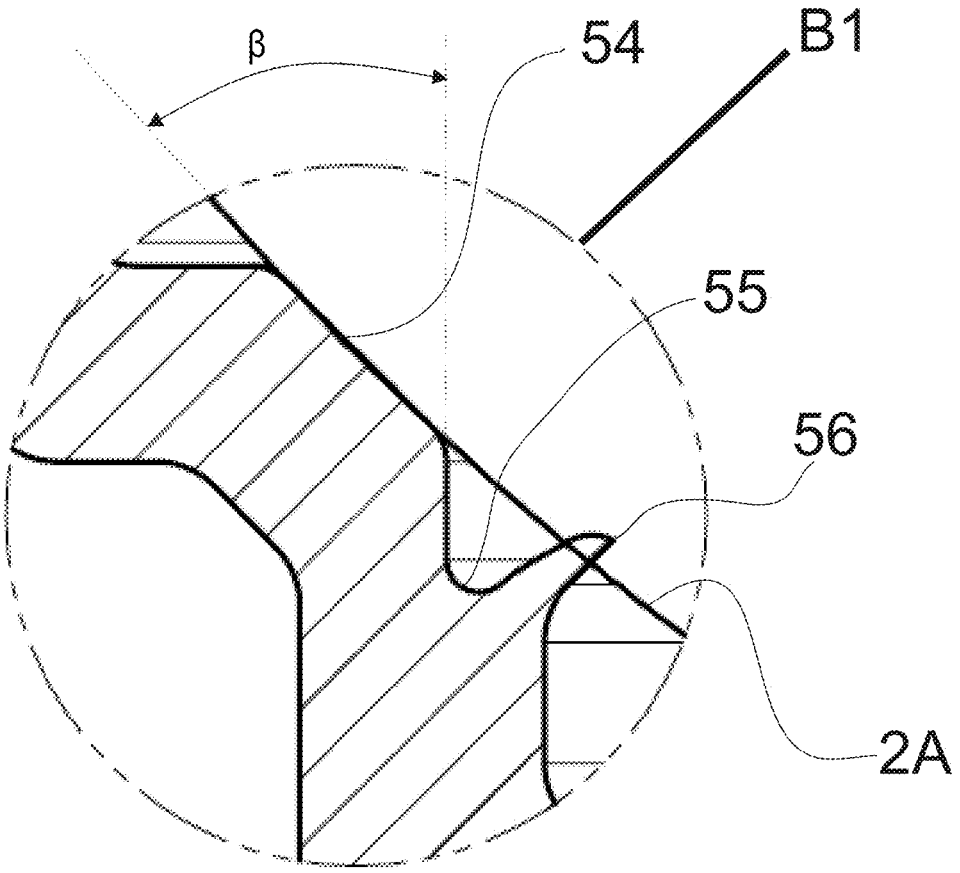
FIG. 11—is a featured representation of detail B1 illustrated in FIG. 10.
Figure 12:
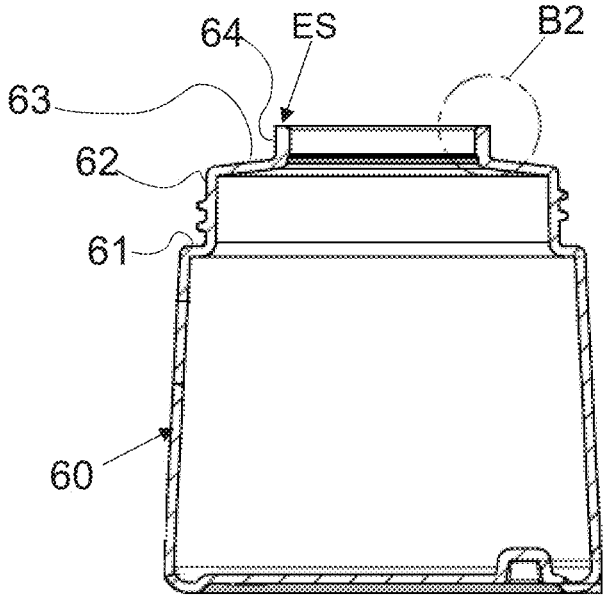
FIG. 12—is an additional representation of the storage portion which integrates the refillable bottle proposed in the present invention.

It is emphasized that FIG. 10 illustrates the detail B1, which detail is more clearly illustrated in FIG. 11, wherein the contours of the applicator ball 2A, the touch point 54, the concave portion 55 and the tooth 56 are observed.

As regards the touch points 54, it is proposed that these be configured as straight surfaces and endowed with a determined tilt β, so that, in a preferred embodiment, said tilt β of the touch point 54 assumes a value of 45°, according to the featured representation of FIG. 11.

FIGS. 5(*b*) and 12 allow a better visualization of the arrangement introduced in the storage portion 3 which integrates the proposed bottle 10. It is noted that the lateral surface 60 of the storage portion 3 is configured as a flat surface and endowed with a slight tilt defined by angle α, so the lateral surface 60 defines a step 61 thus configuring the diameter K and providing a surface 62 which comprises the thread element of the storage portion 3.

Figure 13:
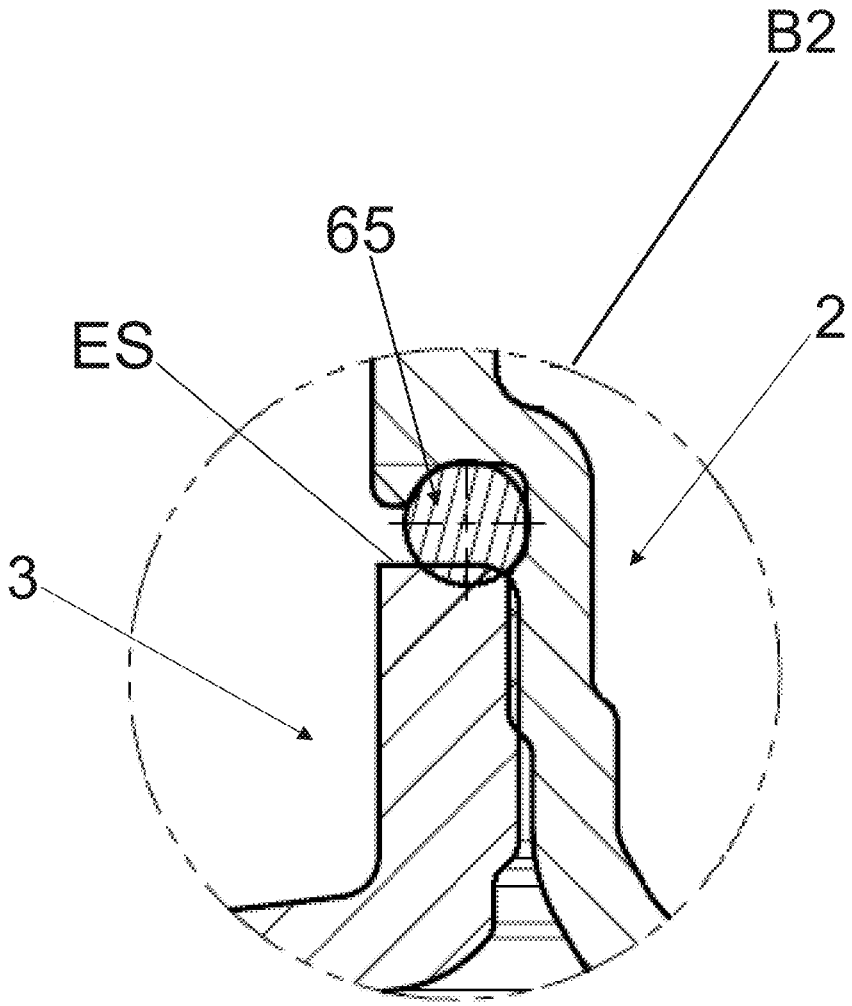
FIG. 13—is a featured representation of detail B2 illustrated in FIG. 12.

From the surface 62 there is defined a new step 63 aiming to connect the surface 62 to a connecting surface 64, wherein the upper surface ES of the connecting surface 64 establishes a point for placing a sealing element 65 (preferably circular), wherein the sealing element 65 establishes a connection between the storage portion 3 and the applicator 2, such as observed in detail B2 prominently illustrated in FIG. 13. FIG. 9 further allows the visualization of the sealing element 65.

Still referring to FIGS. 9 and 10, it is noted that the location point of the sealing element 65 in the applicator 2 is configured as a crib 70 formed by the surface that is opposite to the surface that defines the corrugated stretch 57 and the vertical portion 58. Further referring to FIG. 10, it is observed that the crib 70 is placed at a point in height of the applicator 2 situated between the internal thread thereof 40A and the external thread thereof 40.

In this manner there is described the arrangement introduced in the refillable bottle 10, whereby bottle 10 is endowed with adequate functionality and improvement in the use thereof as regards the possibility of refilling the bottle, thus avoiding the discard of lid 1 and applicator 2. Thus, there is provided a bottle 10 with greater efficiency and convenience in the use and manufacture thereof, said advantages being related to the possibility of refilling of bottle 10 and related to environmental benefits.

Furthermore, it is also highlighted that the description carried out for the storage portion 3 is also valid for the refill 20.

In harmony with the previously made description, the present invention further describes a refill 20 usable in a refillable bottle 10.

Having described an example of preferred embodiment, it must be understood that the scope of the present invention covers other possible variations, being solely limited by the contents of the attached claims, wherein the possible equivalents are included.

The invention claimed is:

1. Refillable bottle (10), comprising:
a lid (1) connectable to an applicator (2), and
a storage portion (3) connectable to the applicator (2),
wherein:
the connection between the lid (1), applicator (2) and storage portion (3) occurs through an arrangement of threads on the lid (1), in the applicator (2) and in the storage portion (3),
the connection between the lid (1) and the applicator (2) occurs by means of an internal thread of the lid (1A) and of an external thread of the applicator (40), wherein an angulation range of the internal thread of the lid (1A) with the external thread of the applicator (2) is between 3.50 to 6.0 degrees, and
the connection between the storage portion (3) and the applicator (2) occurs by means of an internal thread of the applicator (40A) and of an external thread of the storage portion (30), wherein an angulation range of the internal thread of the applicator (40A) with the external thread of the storage portion (30) is between 0.50 to 1.90 degrees.

2. Refillable bottle (10) according to claim 1, wherein:
a pitch of the internal thread (1A) of the lid (1) is situated in the range between 3.0 mm to 3.5 mm, and
a pitch of the external thread of the applicator (40) is situated in the range between 8 mm and 11 mm.

3. Refillable bottle (10) according to claim 2, wherein the pitch of the internal thread (1A) of the lid (1) is 3.3 mm and the pitch of the external thread of the applicator (40) is 10 mm.

4. Refillable bottle (10) according to claim 1, wherein:
the internal thread of the applicator (40A) has a pitch between 2.0 mm and 3.0 mm, and
the external thread of the storage portion (30) has a pitch between 2.0 mm and 3.0 mm.

5. Refillable bottle (10) according to claim 4, wherein the pitch of the internal thread of the applicator (40A) is 2.5 mm and the pitch of the external thread of the storage portion (30) is 2.5 mm.

6. Refillable bottle (10) according to claim 1, wherein the bottle (10) comprises a height (H7) lower than 100 mm, while a width (L) of the bottle (10) is situated in the range between 50 mm to 55 mm.

7. Refillable bottle (10) according to claim 6, wherein the height (H7) is 93 mm and the width (L) is 52.5 mm.

8. Refillable bottle (10) according to claim 1, wherein the refillable bottle (10) is a deodorant bottle.

9. Refillable bottle (10) according to claim 1, wherein the storage portion (3) is replaceable by a refill (20).

10. Refillable bottle (10) according to claim 1, wherein the applicator (2) comprises an applicator ball (2A).

11. Refill (20) usable in the refillable bottle (10) of claim 1.

* * * * *